United States Patent [19]

Williams

[11] Patent Number: 4,672,368

[45] Date of Patent: Jun. 9, 1987

[54] RASTER SCAN DIGITAL DISPLAY SYSTEM

[75] Inventor: Donald W. Williams, Boca Raton, Fla.

[73] Assignee: International Business Machines Corporation, Armonk, N.Y.

[21] Appl. No.: 723,130

[22] Filed: Apr. 15, 1985

[51] Int. Cl.[4] ..... G09G 1/16

[52] U.S. Cl. ..... 340/703; 340/798; 340/799

[58] Field of Search ..... 340/703, 744, 747, 748, 340/750, 701, 798, 799

[56] References Cited

U.S. PATENT DOCUMENTS

| | | | |
|---|---|---|---|
| 4,149,152 | 4/1979 | Russo | 340/703 |
| 4,364,037 | 12/1982 | Walker | 340/703 X |
| 4,420,770 | 12/1983 | Rahman | 340/750 X |
| 4,437,092 | 3/1984 | Dean et al. | 340/703 |
| 4,447,809 | 5/1984 | Kodama et al. | 340/703 X |
| 4,481,594 | 11/1984 | Staggs et al. | 340/703 X |
| 4,516,266 | 5/1985 | Christopher et al. | 340/701 |
| 4,521,770 | 6/1985 | Rhyne | 340/703 |
| 4,635,048 | 1/1987 | Nishi et al. | 340/799 |

*Primary Examiner*—Gerald L. Brigance

[57] ABSTRACT

A raster scan digital display system of the type in which consecutive locations in a buffer store are accessed to provide a picture element data stream, has means to increase the number of bits in each picture element data group. Each applied buffer store address is compared with a preselected address. When equality is detected, the value of the extra picture element bits is set, and a new preselected address is generated. The value of the extra picture element bits remains constant until equality between the new preselected address and an applied buffer store address is detected, when the extra bit value is changed and a new preselected address is provided.

7 Claims, 2 Drawing Figures

RASTER SCAN DIGITAL DISPLAY SYSTEM

TECHNICAL FIELD

The present invention relates to a digital display system using a raster scanned display device, for example a cathode ray tube.

BACKGROUND ART

Digital display systems using cathode ray tube display devices have been used for many years. The earliest of these devices used a beam positioning arrangement in which the digital input signals defined the deflection of the C.R.T. beam so that lines were drawn on the C.R.T. face as the beam moved along the path defining each line. Such systems have now been largely replaced by raster scanning systems in which the display is generated by modulating the CRT beam as it scans across the CRT face in a repetitive raster configuration. There are two arrangements for generating the beam modulation signal, the first is the character generation method, and the second is by use of an all points addressable refresh buffer store. It is to the second of these that the present invention relates. In this arrangement, digital data groups representing picture elements of the display are stored in sequence in a large refresh buffer store. They are stored in the same sequence as they are required to generate the picture elements on the screen. In order to refresh the C.R.T. display, the groups are read out in sequence to drive the display.

An early example of an all points addressable display arrangement is shown in U.S. Pat. No. 3,293,614 (Fenimore et al). In one embodiment of the system shown therein, the refresh store has one bit position for each screen picture element. These bits are read from the store in an order and at a rate corresponding to their presentation on a cathode ray tube display. In this system, each displayed picture element is represented by a single bit only so that the CRT beam is only either on or off for each position, and no colors or graduated gray elements can be displayed. Even with this limitation, for the described display, which has 512 elements per line and 410 useful lines per a frame, total of 209,920 stored data bits are required. For a later described embodiment using a color display, four stored bits for each picture element are used, this requires a storage space of about 840,000 bits or about 105K bytes.

Thus, the all points addressable system is relatively expensive in terms of buffer storage requirements. On the other hand, there is a requirement, especially in the color graphics display field, for more bits per picture element to define more different colors on the display. Similarly for some black and white displays high definition half tone images are required.

In order to increase the number of available colors or gray tones in a display, the palette system was developed. An early example of such a system is shown in an article entitled 'Computer Graphics in Color' by P. B. Denes, which appeared in the Bell Lab. Records, Volume 52, May, 1976 on pages 139 through 146. In that system, points addressable refresh buffer memory is arranged to provide three bits for each picture element to be displayed. This, of course, would normally provide data to permit 8 different colors on the display tube. However, instead of driving the color drive signals directly from the refresh buffer data, each data group of 3 bits is used to select one of 8 sets of palette registers. Each of these sets stores a total of 21 bits of data, of which repetitive groups of 7 are used to generate red, blue and green signals through repetitive digital-to-analog converters. The feature which gives this color palette system great color flexibility is that the contents of the registers can be altered by the computer driving the display system. The article states that typically they might be changed after the display of each frame is completed. The major limitation of the system is that frequent changes of the data in the registers, that is, several changes within a display frame time, uses an undesirable amount of computer time. Thus, to achieve efficient operation of the computer, each display frame is normally restricted to eight colors, though these colors can be changed for successive frames.

One method of overcoming this limitation, though in a very restricted application, is shown in U.S. Pat. No. 4,225,861 (Langdon et al). In that arrangement, the palette system, called "video lookup table" in the specification, has four zones. The palette system is addressed by the picture element outputs from the refresh buffer together with two selected bits of each address of the refresh buffer used to read out this buffer. These selected bits direct successive picture element outputs to successive ones of the zones. By this means, a textured display pattern is generated.

DISCLOSURE of the INVENTION

According to the present invention, a raster scan digital display system of the type in which consecutive locations in a refresh buffer store are accessed to generate a stream of picture element data is provided. The refresh buffer addresses are each compared with a preselected address, and, on detection of equality, a group of further picture element data bits is generated, thereby expanding the number of bits in each picture element data group, and a new preselected address is generated. The further picture element data bit group remains fixed until equality is detected between the next preselected address and a further refresh buffer address. Thus, different areas of the raster scan display, as defined by the preselected addresses have colors (or gray levels) selected from different picture element data groups as defined by the further picture element data bits.

DETAILED DESCRIPTION of an EMBODIMENT of the INVENTION

Figure 1:
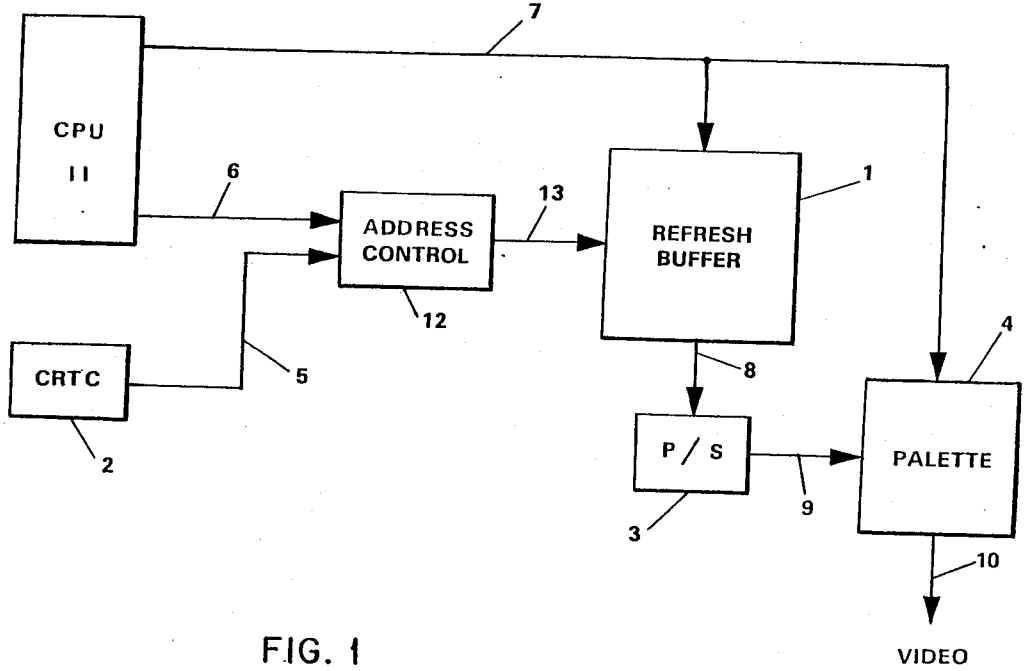
FIG. 1 (PRIOR ART)
FIG. 1 is a simplified block diagram of all points addressable digital display system including a palette register system.

Referring firstly to FIG. 1, this is a block diagram of a known digital display system. The system comprises a C.P.U. 11, an address control unit 12, a refresh buffer store 1, a CRT controller 2, a parallel/serial converter 3, and a palette system 4. Refresh buffer store 1 is coupled to an address bus 13, along which are passed address signals from address control unit 12 to address the store either from CRT controller 2 or, through an address bus 6, from C.P.U. 11. A data bus 7 couples data from CPU 11 to refresh store 1, and data is passed from this store to a parallel/serial converter 3 over a further data bus 8. The parallel/serial converter applies selection signals over a bus 9 to select the registers in palette system 4 in response to data on bus 8 from the refresh store. Digital video display signals, read from selected registers in the palette register system, are passed over a bus 10 to a display device, for example, a color C.R.T. monitor device. For the purpose of this description, we will make the following assumptions:

(a) The display has a resolution of 640×200 picture elements, making a total of 128,000 such elements.

(b) Each element can be a selected one of 4096 colors or gray levels.

(c) The refresh store holds 4 bits for each picture element to be displayed.

With these parameters, in the FIG. 1 system, the refresh store will require a capacity of 64K bytes, and the palette system will contain sixteen registers, each having twelve bit positions. For a color display, these twelve bits are applied over video bus 10 to the display controller where four each are coupled respectively to the red, green and blue CRT gun driver circuits to generate the 4096 different colors.

In operation, the refresh buffer store is loaded from the CPU over data bus 7 and using address bus 6. This data is loaded in such a way that, on sequential readout from the refresh buffer store under the control of CRT controller 2, successive picture element data will be generated. Each successively accessed location delivers a byte to P/S circuit 3 which then serializes this byte into two four bit groups which successively select two palette registers to provide two sets of picture element data.

Figure 2:
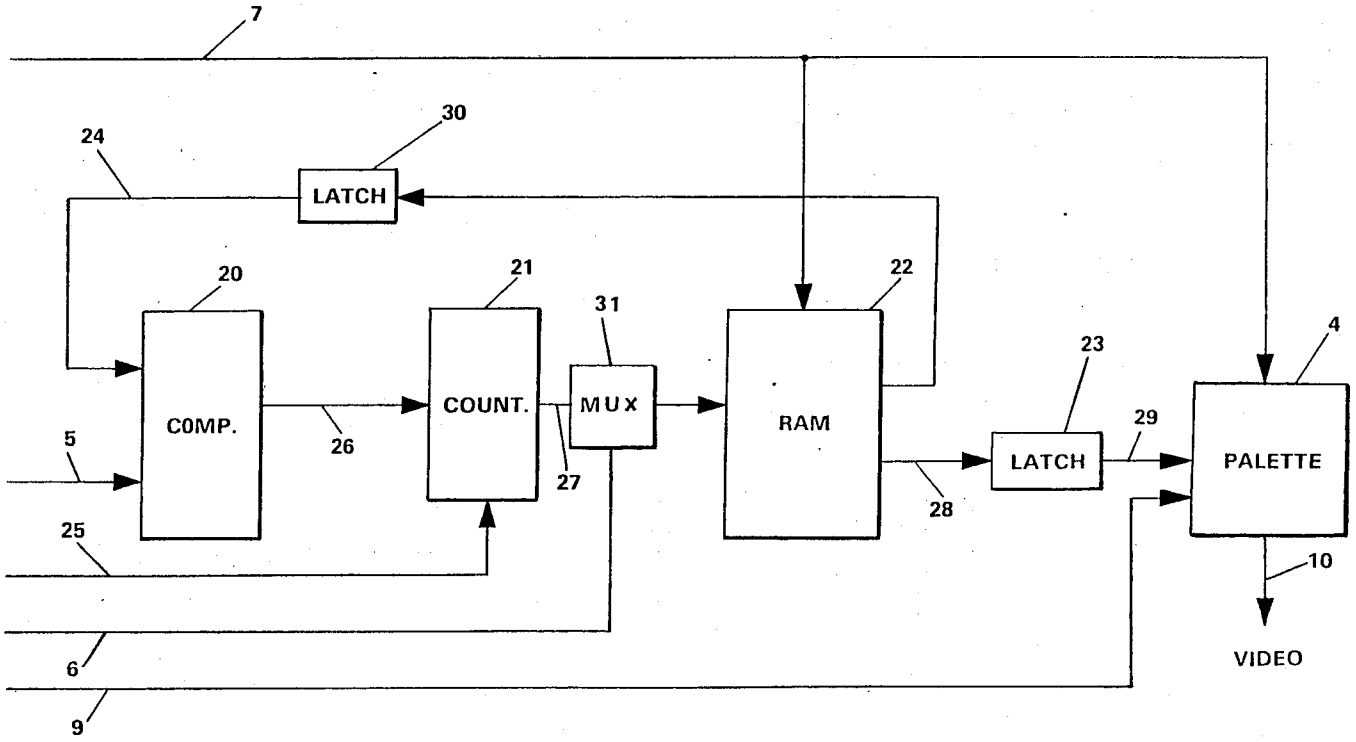
FIG. 2 is a block diagram of a circuit for use in the FIG. 1 system to expand the available number of registers in the palette system.

Referring now to FIG. 2, this is a block diagram of a palette selector expansion system for use in the FIG. 1 system. The object of this expansion system is to increase the number of registers in the palette system which can be accessed without enlarging the refresh store. In FIG. 2, the palette register system is again shown as block 4 with the four line input bus 9 and 12 line output video bus 10. In this figure, however, the palette register system now has 64 registers as opposed to the 16 in the FIG. 1 system, and therefore requires two extra selector lines in addition to the four in bus 9. Then two extra lines are shown as a bus 29. To generate the signals on bus 29, a control system comprising a comparator 20, a counter 21, a random access store 22 and a two bit latch 23 is provided. The comparator is coupled to receive, on bus 5, the address signals applied to refresh buffer 1 (FIG. 1) when this buffer is read for display refresh. As explained above, these address sequential addresses in the refresh store, with each address being defined by 16 bits. Comparator 20 also receives a further 16 bits over a bus 24 for comparison with the address bit on bus 5. As will be explained in detail later, these bits on bus 24 define selected points on the display screen. On detection of equality between the signals on busses 5 and 24, comparator 20 emits a single signal on a line 26. This signal is used to increment a counter 21 by one. This counter also receives a reset input on a line 25 at the vertical retrace time of the display CRT to reset it for the start of each display frame. The output of counter 21 is applied over a bus 27 to address random access memory 22 through a multiplexer 31. This multiplexer is switchable to direct the address data from bus 27 to memory 22 during scan times of the display device and to direct addresses from CPU 11 over address bus 6 to memory 22 during vertical retrace times of the display device thereby to update memory 22 with data from CPU 11 over bus 7 during the retrace times. At the start of a display frame, counter 21 contains a reset count, and it is incremented each time comparator 20 detects equality between its respective inputs. Memory 22 comprises a number of locations each storing eighteen bits, of which sixteen provide the addresses applied to comparator 20 over bus 24 through latch 30 and two are applied to bus 28. In this description, we may assume that memory 22 has 500 locations, and therefore can receive 500 consecutive address inputs from counter 21 over bus 27. The two output bits on line 28 are applied to a latch 23 where they are held to provide two selection bits on bus 29 to palette register system 4. With these two bits and the four bits from P/S 3 over line 9, palette register system 4 now has a total of six selection lines to select the registers, and can be expanded to contain 64 registers without the need for further selector lines on bus 9 and, therefore, no expansion of the refresh buffer store 1. The way this is achieved is by selectively re-defining the two selector digits on bus 29 from R.A.M. 22.

At the start of a display frame, counter 21 output is the initial address in RAM 22, so the first address location in RAM 22 is accessed to provide a sixteen bit address output to latch 30 and a two bit palette selection output to latch 23. Now, as the display scans, successive groups of four bits, derived from refresh buffer 1, are applied over bus 9 to the palette system 4, each group representing one picture element. Each of these four bit groups selects one of a group of sixteen registers within the 64 registers in the palette system, this group being delimited by the two bits from latch 23. The address in latch 30 indicates a refresh buffer address at which the color set is to be changed. Accordingly, comparator 20 looks for equality between the successive refresh buffer addresses on line 5 and the address held in latch 30. When this is found, an output on line 26 increments counter 21 by one so that its output now changes from the initial RAM 22 address to that address plus one, this being the new address for RAM 22. The address data from this new location is now sent to latch 30 over bus 24 and the two new palette selection bits are applied to latch 23 so that the four palette selection bits on bus 9 now make selections from a new group of sixteen registers in palette system 4 as defined by the two new bits in latch 23. These selections continue until again equality is detected between a refresh store address and the address in latch 30 and the process is repeated. If RAM 22 has 500 available locations, then a maximum of 500 such changes can be made during each display frame, with switching between any of the four groups of palette registers defined by the two bits on bus 29 being achieved at each change.

As an example of operation of the system, we may take a very simple screen configuration in which the screen is divided into four equal windows, each with a different color configuration. Let us define the top left hand window as using a color group A, the top right hand as using a color group B, the bottom left hand as using a color group C and the bottom right hand as using a color group D. As mentioned previously, we are assuming a 640×200 element picture and can take the first address in the refresh buffer store 1 as address 0.

At the start of scanning, counter 21 has been reset to the initial RAM 22 address and therefor addresses the initial location of RAM 22, from which is retrieved an address '160' which is passed to latch 30, and the two palette selection bits for color group A, say binary '00', which are applied to latch 23. As the first scan line is traced through elements 0 through 319, the color of each element thereof is defined, within group A, by the selections of the sixteen registers in the palette system defining this group. When the first scan line passes the half way point on the screen, refresh buffer location '160', which corresponds to the first picture element in the second half of the scan line, is addressed. Note that this is '160' but it relates to the 320th picture element in this scan line as each byte read from the refresh buffer corresponds to two successive picture elements, each defined by four bits. This refresh buffer address, which is passed to comparator 20 over bus 5 is the same as that in latch 30, so comparator 20 generates an output signal to increment counter 21. This counter, therefore, now addresses the next location of RAM 22 from which an address '320' is applied to latch 30, and color group B bits, say binary '10', are applied to latch 23. Thus, for the remainder of this scan line, the palette selection for each picture element is made from the sixteen registers in group B. At the start of the second line, that is at picture element 640, the comparator again detects equality, and increments the counter to generate the third address of RAM 22. This address contains the refresh buffer address corresponding to the first picture element in the second half of this line (address '480') together with the color group A bits. This sequence continues down through to the end of scan line 99.

At the start of scan line 100, which corresponds to buffer address '32000', counter 21 is incremented to provide the two hudredth sequential address of RAM 22. RAM 22 responds by generating address '32160' to latch 30 and the two bits corresponding to color group C, say binary '01', to latch 23. Accordingly, for the first half of this scan line the sixteen registers in group C in the palette system 4 are selected by the signals on bus 9. At the beginning of the second half of this scan line, which corresponds to the picture element related to address '32160' in refresh buffer store, counter 21 is again incremented from comparator 20 to generate the next address of RAM 22. From this address is obtained the buffer address for the first element of the next scan line and two bits corresponding to color group D, say binary '11'. This group is therefore used for the remainder of the line. This switching between color groups C and D continues for all the remaining scan lines of the display. Accordingly each quarter of the display uses its own unique group of sixteen registers in the color palette system.

It is, of course, clear that the colors defined by the contents of the color palette registers are still determined by the values entered into these registers from the CPU 1, and these can still be changed over bus 7 during vertical retrace times of the display thereby retaining the flexibility of the palette system. This flexibility is now, however, enhanced by the provision of means to change the selection of register groups within the palette system during the raster scan. In addition, of course, RAM 22 can also be updated from the host CPU during the vertical retrace time to re-define the points of change between color groups and also to define the groups between which each change is made. The above example of the use of the present invention, that is providing four distinctively colored quadrants on a display screen is only a simple application of the invention. In practice, its primary use would be in the production of complex high definition digital displays.

One example would be in the production of a pictorial display in an operator interactive system. Let us assume that the display shows an object in which initially, due to the use of identical coloring, a portion of an edge of the object merges into the background. Now, by selecting this edge portion of the object as points in the display for color group changes, this portion can be arranged to provide slightly differing colors or color intensities as the display is scanned over the edge portion thereby to display a clearly defined edge of the object.

In summary, what has been shown is a digital display system using an all points addressable refresh buffer store to drive a raster scan display device through a palette register system. The palette register system includes more registers then the number that can be selected by the data from the refresh buffer store. The extra selection bits are derived from a random access memory which is addressed by a counter. This counter is incremented by signals from a comparator which compares each refresh buffer store address with address data sent from the random access memory and, on detection of equality, forwards such an incrementing signal. Thus different groups of registers in the palette register system are used during different portions of the raster scan.

While the invention has been particularly described with reference to a preferred embodiment, it will be understood by those skilled in the art that various changes in form and detail may be made without departing from the spirit and scope of the invention.

What is claimed is:

1. A raster scan display system including a refresh buffer store, address means for generating consecutive location addresses of an area of the buffer store to derive, from the buffer store data, a stream of display data groups, each group corresponding to a display picture element, means for storing a selectively changeable table of selected ones of said location addresses, each entry in the table further including predetermined further display data, detection means coupled to the address means and said means for storing for generating a detect signal on detection of equality between a location address from said address means and a location address from said table, means responsive to a said detect signal to address a further entry in said table, and means responsive to said further display data and said display data groups in combination for defining the display picture elements.

2. A raster scan display system according to claim 1 including latch means for latching location addresses read from said means for storing, said latch means being coupled to said detection means for providing a fixed location address to the detection means between addressing of said entries in the table.

3. A raster scan display system system according to claim 2 including further latch means for latching said further display data from said means for storing, said further latch means being coupled to said means responsive for providing fixed further display data between addressing of said entries in the table.

4. A raster scan display system according to claim 1 in which said detection means comprises a comparator for comparing location addresses from said address means and said table, and said means responsive to a detect signal comprises counter means coupled for incrementation by each said detect signal to provide successive addresses to said means for storing.

5. A raster scan display system according to claim 4 including means for resetting said counter means during each vertical retrace of the raster scan display.

6. A raster scan display system according to claim 1 including means coupled to the means for storing for amending the entries in said table.

7. A raster scan display system according to claim 1 in which said means responsive comprises a color palette register system including two to the power "n" registers where "n" is an integer comprising the number of digits in each display data group plus the number of digits in each group of further display data, said registers being selected by concatenations of each display data group and group of further display data.

* * * * *